US012648615B2

(12) United States Patent
Mokos et al.

(10) Patent No.: US 12,648,615 B2
(45) **Date of Patent: *Jun. 9, 2026**

(54) SHOE WITH MULTIPLE MATERIAL SOLE

(71) Applicant: Cole Haan LLC, Greenland, NH (US)

(72) Inventors: Jeffrey Mokos, Greenland, NH (US); Scott Patt, Greenland, NH (US); Kyle Jenkins, Greenland, NH (US); Mattias Verfl, Greenland, NH (US); Michael Weyrauch, Greenland, NH (US); Jose A. Tejada Bernard, Greenland, NH (US)

(73) Assignee: COLE HAAN LLC, Greenland, NH (US)

( * ) Notice: Subject to any disclaimer, the term of this patent is extended or adjusted under 35 U.S.C. 154(b) by 545 days.

This patent is subject to a terminal disclaimer.

(21) Appl. No.: 17/712,457

(22) Filed: Apr. 4, 2022

(65) Prior Publication Data

US 2022/0225730 A1 Jul. 21, 2022

Related U.S. Application Data

(63) Continuation of application No. 16/698,940, filed on Nov. 27, 2019, now Pat. No. 11,297,897.

(51) Int. Cl.

| | |
|---|---|
| ***A43B 13/18*** | (2006.01) |
| ***A43B 1/00*** | (2006.01) |
| ***A43B 13/04*** | (2006.01) |
| ***A43B 13/12*** | (2006.01) |
| ***A43B 13/16*** | (2006.01) |

(52) U.S. Cl.

CPC ..... *A43B 13/187* (2013.01); *A43B 1/0072* (2013.01); *A43B 13/04* (2013.01); *A43B 13/125* (2013.01); *A43B 13/16* (2013.01)

(58) Field of Classification Search

USPC ..... 2/25 R, 28, 31, 103

See application file for complete search history.

(56) References Cited

U.S. PATENT DOCUMENTS

| | | | |
|---|---|---|---|
| 4,364,188 | A | 12/1982 | Turner et al. |
| 6,038,790 | A | 3/2000 | Pyle et al. |
| 6,601,319 | B1 | 8/2003 | Clements |

(Continued)

FOREIGN PATENT DOCUMENTS

| | | | |
|---|---|---|---|
| EP | 1714571 | A1 | 10/2006 |
| WO | 2018013802 | A1 | 1/2018 |

*Primary Examiner* — Matthew R Marchewka

(74) *Attorney, Agent, or Firm* — Thompson Coburn LLP

(57) ABSTRACT

A shoe having a sole. The sole includes a midsole including multiple midsole portions. A first midsole portion is an inner portion of a first midsole material. A second, midsole portion of a second midsole material circumscribes the first midsole portion, and a third midsole portion formed of a third midsole material circumscribes the second midsole portion. The second midsole portion has a greater durometer hardness than the first midsole portion. The third midsole portion has a different durometer hardness than the second midsole portion. The second midsole portion is of a different color than each of the first midsole portion and the third midsole portion. An outsole secured to the midsole is sufficiently translucent so that the first, second, and third midsole portions are visually discernable one from another by a person of normal, unaided vision viewing the outsole.

18 Claims, 19 Drawing Sheets

(56) References Cited

U.S. PATENT DOCUMENTS

| | | | | |
|---|---|---|---|---|
| D814,752 | S | 4/2018 | Ormsby | |
| 10,383,400 | B2 | 8/2019 | Bauerfeind | |
| 2008/0078102 | A1 | 4/2008 | Kilgore et al. | |
| 2011/0283560 | A1 | 11/2011 | Portzline et al. | |
| 2012/0260532 | A1 | 10/2012 | Catalano | |
| 2013/0019505 | A1* | 1/2013 | Borel | A43B 13/127 36/103 |
| 2013/0081306 | A1 | 4/2013 | Park et al. | |
| 2014/0075779 | A1 | 3/2014 | Bruce et al. | |
| 2014/0310981 | A1 | 10/2014 | Abshire et al. | |
| 2015/0101215 | A1 | 4/2015 | Henderson et al. | |
| 2015/0359294 | A1 | 12/2015 | VanHook | |
| 2016/0278481 | A1 | 9/2016 | Le et al. | |
| 2016/0345668 | A1 | 12/2016 | Dyer et al. | |
| 2018/0098601 | A1 | 4/2018 | Hartenstein et al. | |

* cited by examiner

SHOE WITH MULTIPLE MATERIAL SOLE

CROSS-REFERENCE TO RELATED APPLICATIONS

This application claims the benefit of U.S. patent application Ser. No. 16/698,940, filed Nov. 27, 2019, the disclosure of which is incorporated by reference herein.

STATEMENT REGARDING FEDERALLY SPONSORED RESEARCH OR DEVELOPMENT

Not applicable.

APPENDIX

Not applicable.

BACKGROUND OF THE INVENTION

Field of the Invention

The present invention pertains to shoes having soles.

SUMMARY

One aspect of the disclosure is a shoe comprising a sole and an upper secured to the sole. The sole has a sole top side facing the upper and a sole bottom side adapted and configured to engage a ground surface, the sole extending longitudinally from a sole heel end to a sole toe end, the sole extending transversely from a sole lateral edge to a sole medial edge. The sole has a sole heel region, a sole midfoot region, and a sole forefoot region, the sole heel region extending longitudinally from the sole heel end to the sole midfoot region, the sole midfoot region extending longitudinally from the sole heel region to the sole forefoot region, the sole forefoot region including a sole metatarsal region, a sole ball region, and a sole toe region, the sole metatarsal region extending longitudinally from the sole midfoot region to the sole ball region, the sole ball region extending longitudinally from the sole metatarsal region to the sole toe region, and the sole toe region extending longitudinally from the sole ball region to the sole toe end. The sole comprises a midsole and an outsole. The midsole is a one-piece body. The midsole has a midsole heel region in the sole heel region, a midsole midfoot region in the sole midfoot region, and a midsole forefoot region in the sole forefoot region, the midsole midfoot region extending longitudinally from the midsole heel region to the midsole forefoot region, the midsole forefoot region including a midsole metatarsal region in the sole metatarsal region, a midsole ball region in the sole ball region, and a midsole toe region in the sole toe region, the midsole metatarsal region extending longitudinally from the midsole midfoot region to the midsole ball region, the midsole ball region extending longitudinally from the midsole metatarsal region to the midsole toe region. The midsole comprises at least a first midsole portion, a second midsole portion circumscribing the first midsole portion, and a third midsole portion circumscribing the second midsole portion and circumscribing the first midsole portion. The first midsole portion has a first midsole durometer hardness, the second midsole portion has a second midsole durometer hardness greater than the first midsole durometer hardness, and the third midsole portion has a third midsole durometer hardness different from the second midsole durometer hardness. The outsole is secured to a bottom surface of the midsole and has an outsole durometer hardness greater than the second midsole durometer hardness.

According to another aspect of the disclosure, a shoe comprises a sole and an upper secured to the sole. The sole has a sole top side facing the upper and a sole bottom side adapted and configured to engage a ground surface, the sole extending longitudinally from a sole heel end to a sole toe end, the sole extending transversely from a sole lateral edge to a sole medial edge. The sole has a sole heel region, a sole midfoot region, and a sole forefoot region, the sole heel region extending longitudinally from the sole heel end to the sole midfoot region, the sole midfoot region extending longitudinally from the sole heel region to the sole forefoot region, the sole forefoot region including a sole metatarsal region, a sole ball region, and a sole toe region, the sole metatarsal region extending longitudinally from the sole midfoot region to the sole ball region, the sole ball region extending longitudinally from the sole metatarsal region to the sole toe region, and the sole toe region extending longitudinally from the sole ball region to the sole toe end. The sole comprises a midsole and an outsole. The midsole is a one-piece body. The midsole has a midsole heel region in the sole heel region, a midsole midfoot region in the sole midfoot region, and a midsole forefoot region in the sole forefoot region, the midsole midfoot region extending longitudinally from the midsole heel region to the midsole forefoot region, the midsole forefoot region including a midsole metatarsal region in the sole metatarsal region, a midsole ball region in the sole ball region, and a midsole toe region in the sole toe region, the midsole metatarsal region extending longitudinally from the midsole midfoot region to the midsole ball region, the midsole ball region extending longitudinally from the midsole metatarsal region to the midsole toe region. The midsole includes at least a first midsole portion of a first color, a second midsole portion of a second color different from the first color, and a third midsole portion of a third color different from the second color. The second midsole portion circumscribes the first midsole portion. The third midsole portion circumscribes the second midsole portion and circumscribes the first midsole portion. The outsole is secured to the midsole and is sufficiently translucent so that the first, second, and third midsole portions are discernable and distinguishable one from another by a person of normal, unaided vision viewing the outsole.

Further features and advantages of the disclosed subject matter, as well as its operation, are described in detail below with reference to the accompanying drawings.

Figure 1:
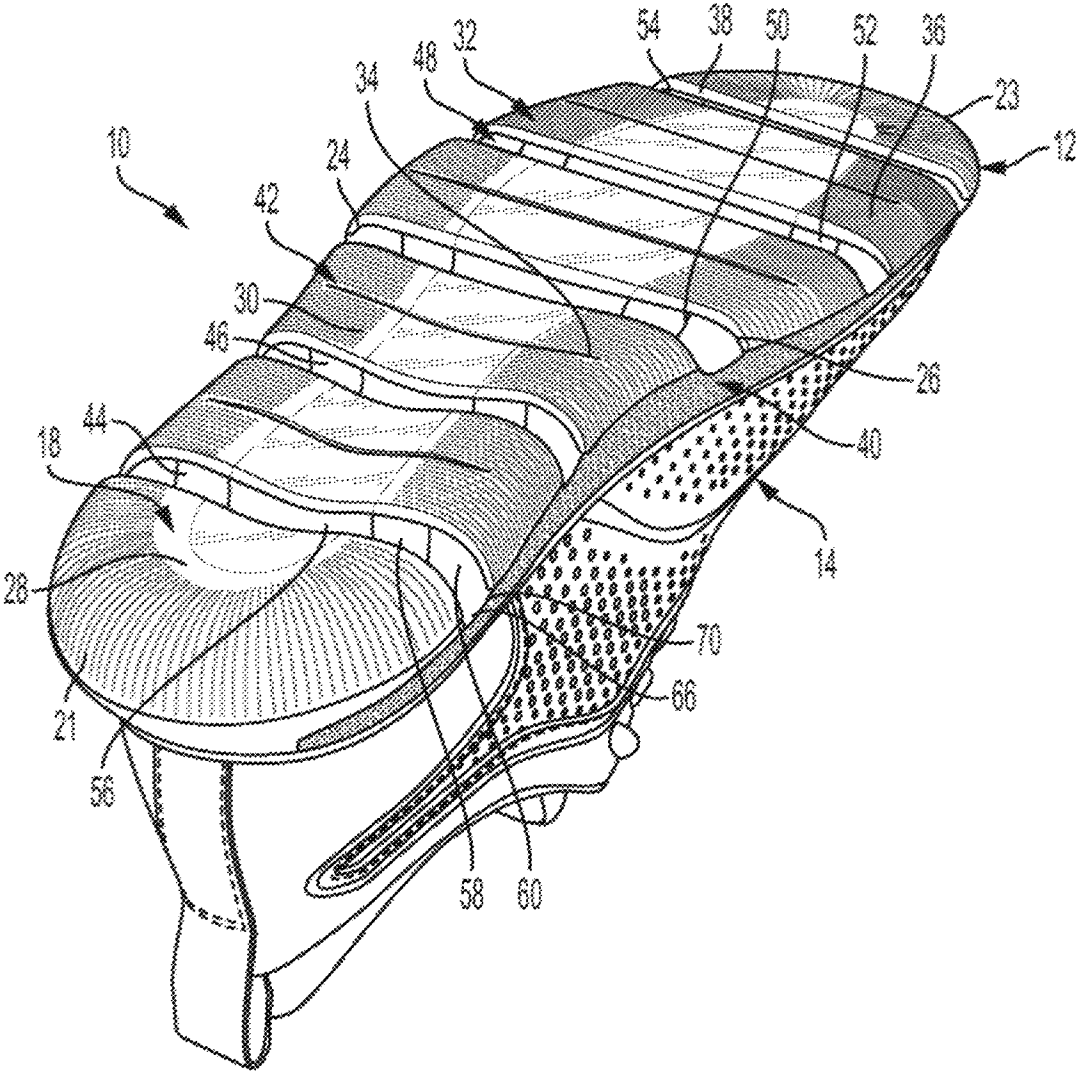
FIG. 1 is a bottom medial rear perspective view of a shoe in accordance with an aspect of the disclosure.
Figure 2:
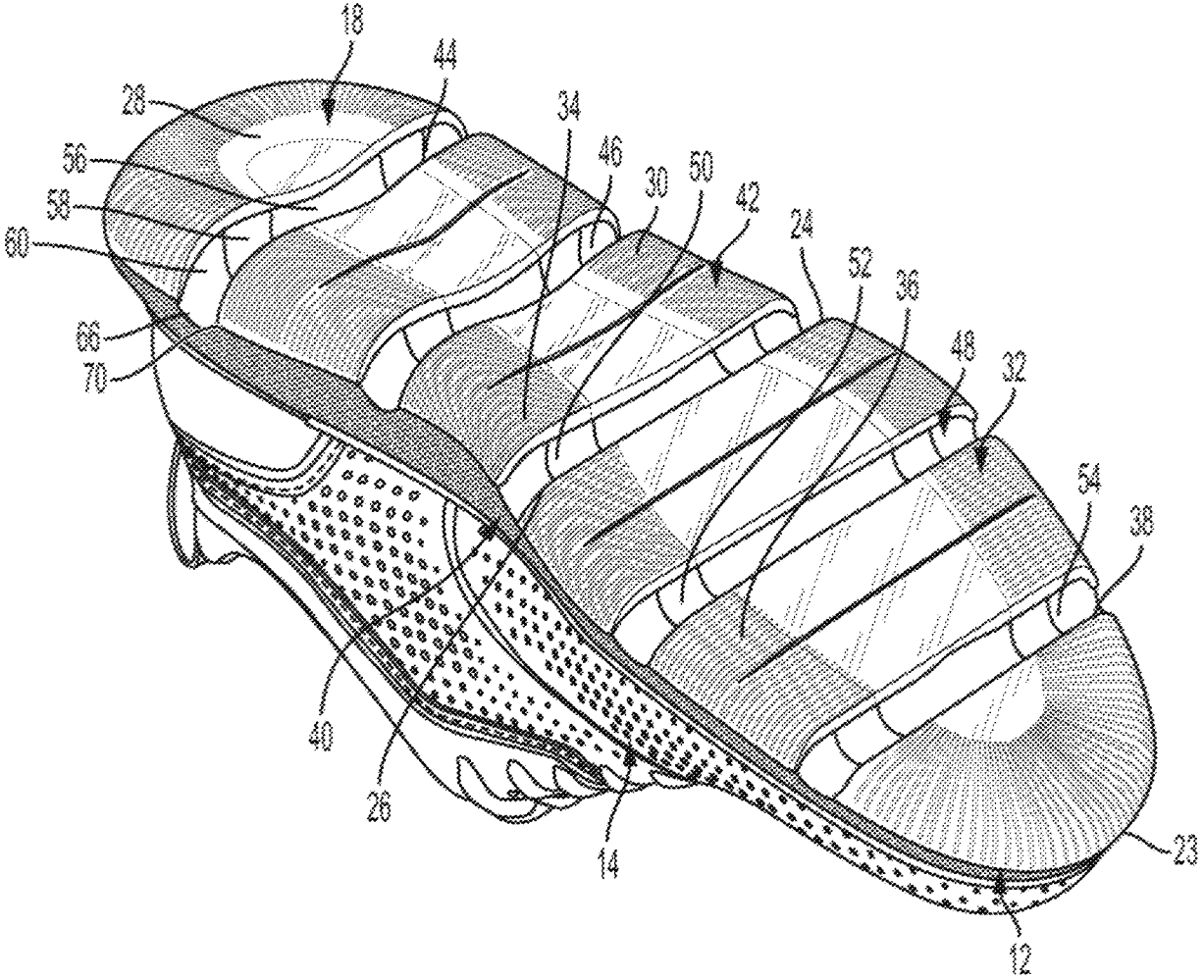
FIG. 2 is a bottom medial front perspective view of the shoe of FIG. 1.
Figure 3:
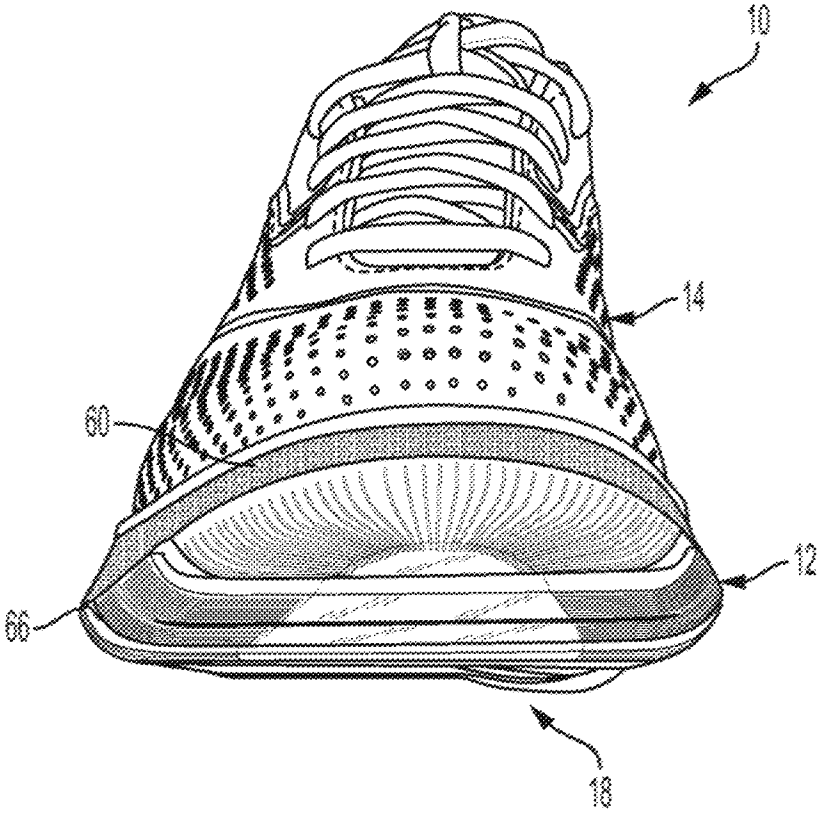
FIG. 3 is a front elevation view of the shoe of FIG. 1.
Figure 4:
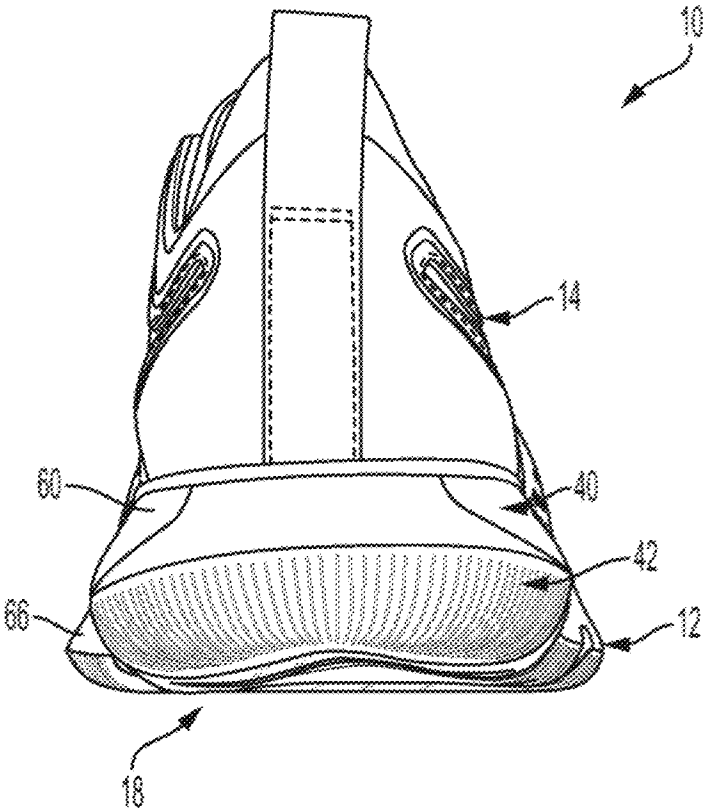
FIG. 4 is a rear elevation view of the shoe of FIG. 1.
Figure 5:
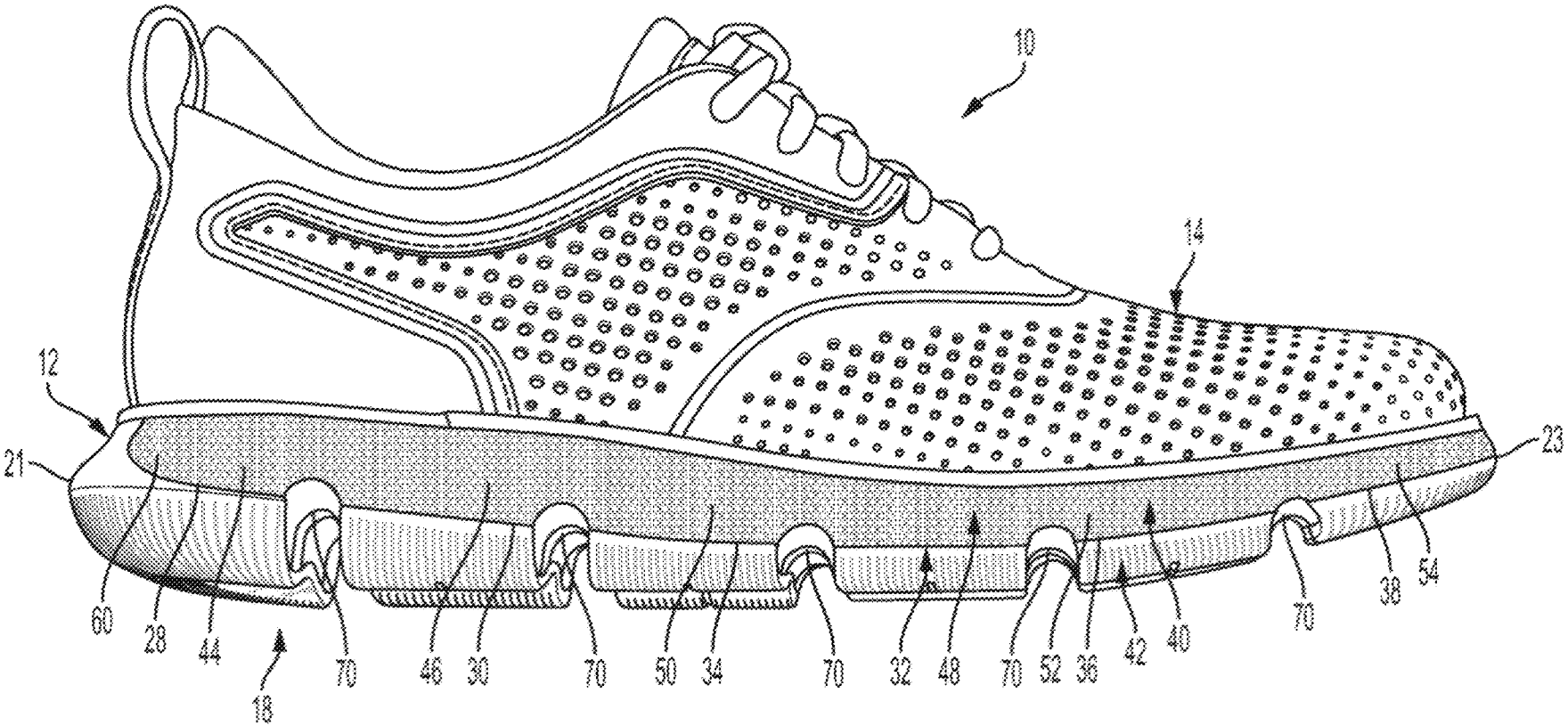
FIG. 5 is a lateral side elevation view of the shoe of FIG. 1.
Figure 6:
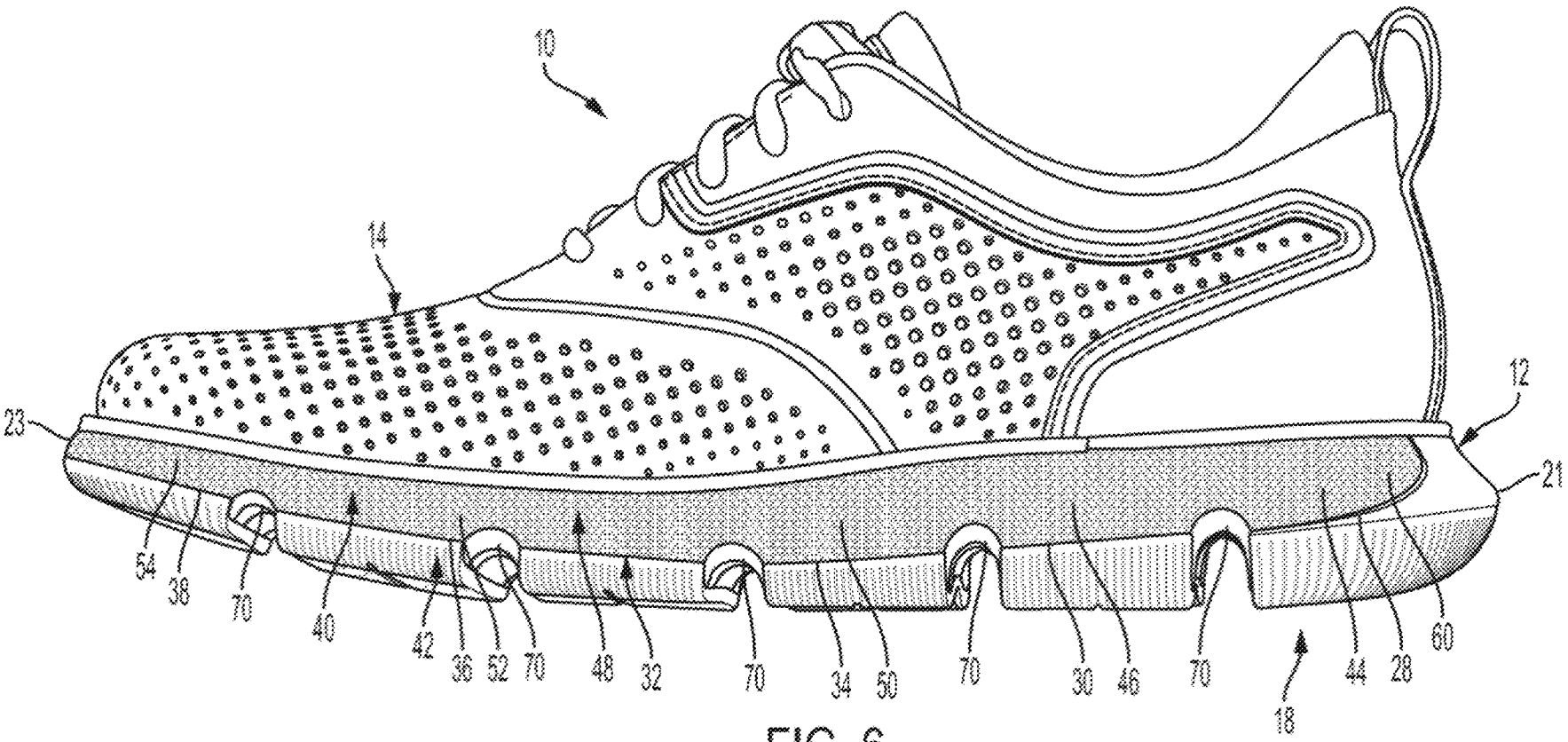
FIG. 6 is a medial side elevation view of the shoe of FIG. 1.
Figure 7:
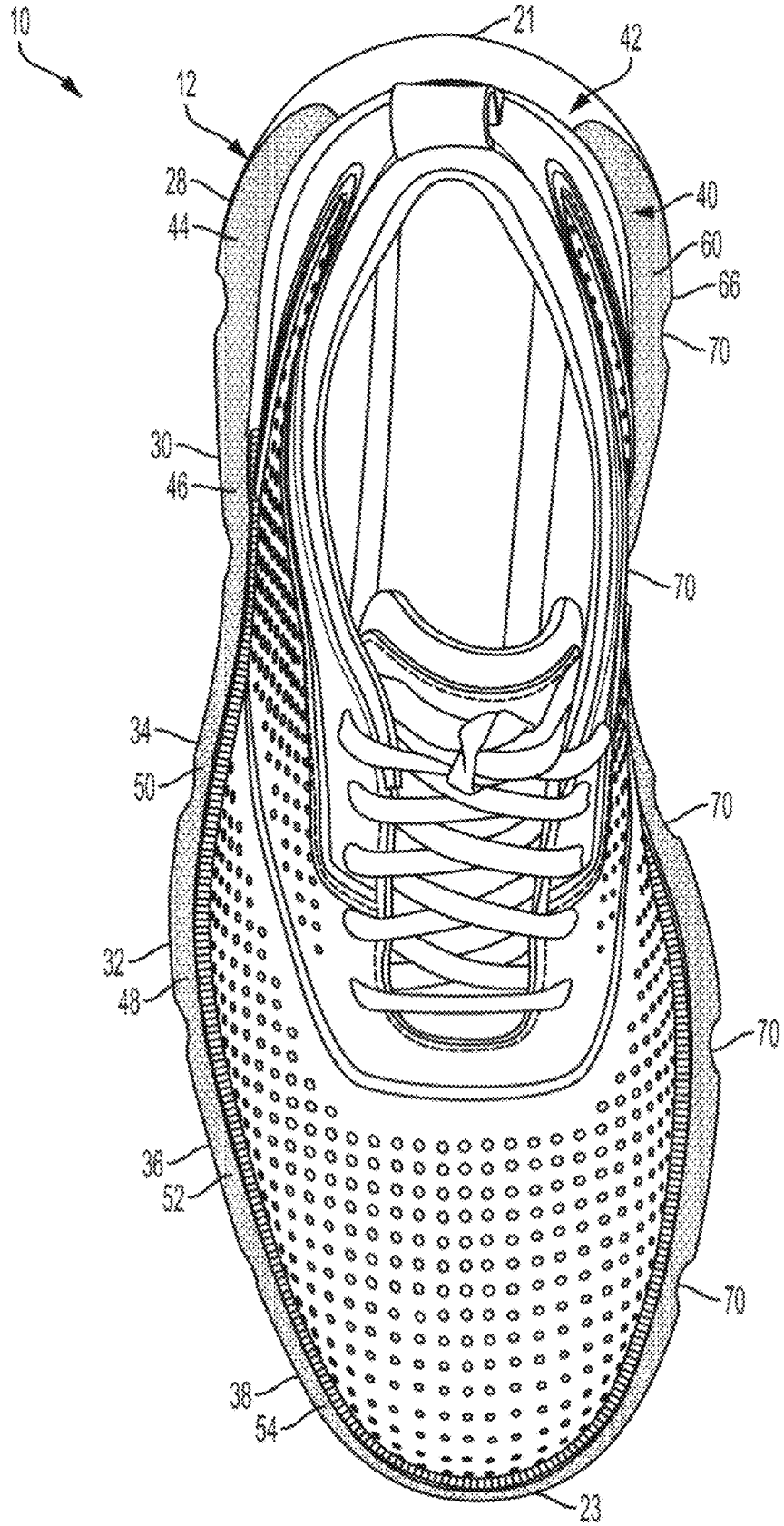
FIG. 7 is a top plan view of the shoe of FIG. 1.

Reference numerals in the written specification and in the figures indicate corresponding items.

DETAILED DESCRIPTION

An embodiment of a shoe in accordance with the present disclosure is indicated by reference numeral 10 and depicted in FIGS. 1-8. Another embodiment is a shoe 10' depicted in FIG. 8A. A sole 12 of the shoe 10 is illustrated by line drawings in FIGS. 9-19. Another embodiment is a shoe 20, depicted in FIG. 20. Still another embodiment is a shoe 20', depicted in FIG. 20A. A sole 22 of the shoe 20 is illustrated by line drawings in FIGS. 21-31.

The shoe 10 comprises the sole 12 and an upper 14 secured to the sole 12. The sole 12 has a sole top side 16 facing the upper and a sole bottom side 18 adapted and configured to engage a ground surface, the sole 12 extending longitudinally from a sole heel end 21 to a sole toe end 23. The sole 12 extends transversely from a sole lateral edge 24 to a sole medial edge 26. The sole 12 has a sole heel region 28, a sole midfoot region 30, and a sole forefoot region 32, the sole heel region 28 extending longitudinally from the sole heel end 21 to the sole midfoot region 30, the sole midfoot region 30 extending longitudinally from the sole heel region 28 to the sole forefoot region 32, the sole forefoot region 32 including a sole metatarsal region 34, a sole ball region 36, and a sole toe region 38, the sole metatarsal region 34 extending longitudinally from the sole midfoot region 30 to the sole ball region 36, the sole ball region 36 extending longitudinally from the sole metatarsal region 34 to the sole toe region 38, and the sole toe region 38 extending longitudinally from the sole ball region 36 to the sole toe end 23.

The sole 12 comprises a midsole, indicated generally at 40, and an outsole, indicated generally at 42, secured to a bottom surface 62 of the midsole 40. The midsole 40 is a one-piece body having a midsole heel region 44 in the sole heel region 28, a midsole midfoot region 46 in the sole midfoot region 30, and a midsole forefoot region 48 in the sole forefoot region 32, the midsole midfoot region 46 extending longitudinally from the midsole heel region 44 to the midsole forefoot region 48, the midsole forefoot region 48 including a midsole metatarsal region 50 in the sole metatarsal region 34, a midsole ball region 52 in the sole ball region 36, and a midsole toe region 54 in the sole toe region 38, the midsole metatarsal region 50 extending longitudinally from the midsole midfoot region 46 to the midsole ball region 52, the midsole ball region 52 extending longitudinally from the midsole metatarsal region 50 to the midsole toe region 54.

The midsole 40 includes a first midsole portion 56 of a first color, a second midsole portion 58 of a second color different from the first color, the second midsole portion 58 circumscribing the first midsole portion 56. A third midsole portion 60 of a third color different from the second color circumscribes the second midsole portion 58 and circumscribes the first midsole portion 56. The third color may also be different from the first color. The outsole 42 is sufficiently translucent so that the first, second, and third midsole portions 56, 58, 60 are discernable and distinguishable one from another by a person of normal, unaided vision viewing the outsole 42. The first, second, and third midsole portions 56, 58, 60 extend from the midsole bottom surface 62 to a top surface 64 of the midsole 40. The third midsole portion 60 extends to a perimeter 66 of the midsole, which is also the perimeter of the third midsole portion 60. The second midsole portion 58 contacts the entire perimeter of the first midsole portion 56, and the third midsole portion 60 contacts the entire perimeter of the second midsole portion 58.

The first midsole portion 56 is softer than the second midsole portion 58; that is, the first midsole portion 56 has a first midsole durometer hardness less than a second midsole durometer hardness of the second portion 58. The third midsole portion 60 has a third midsole durometer hardness different from the second midsole durometer hardness. The third midsole durometer hardness may by greater than or equal to the first midsole durometer hardness and greater than or less than the second midsole durometer hardness. The outsole 42 is typically harder than any of the midsole portions 56, 58, 60. In an embodiment, the first midsole portion 56 is of a first ethylene-vinyl acetate (EVA) foam having a durometer hardness of about 55+/−2 Asker C, the second midsole portion 58 is of a second EVA foam having a durometer hardness of about 60-70 Asker C, and the third midsole portion 60 is of a third EVA foam having a durometer hardness of about 60+/−2 Asker C. The outsole 42 is of a thermoplastic polyurethane (TPU) rubber having a durometer hardness of about 70+/−2 Shore A.

The midsole bottom surface 62 has a plurality of longitudinally spaced apart flex grooves 70 formed thereon, each flex groove 70 having an area extending transversely from the sole lateral edge 24 to the sole medial edge 26 and longitudinally between a flex groove rear edge 72 and a flex groove front edge 74. The sole 12 devoid of the outsole 42 in the area of each flex groove 70. In the illustrated embodiments, midsole portions 56, 58, and 60 are exposed in the area of each flex groove 70.

Figure 8:
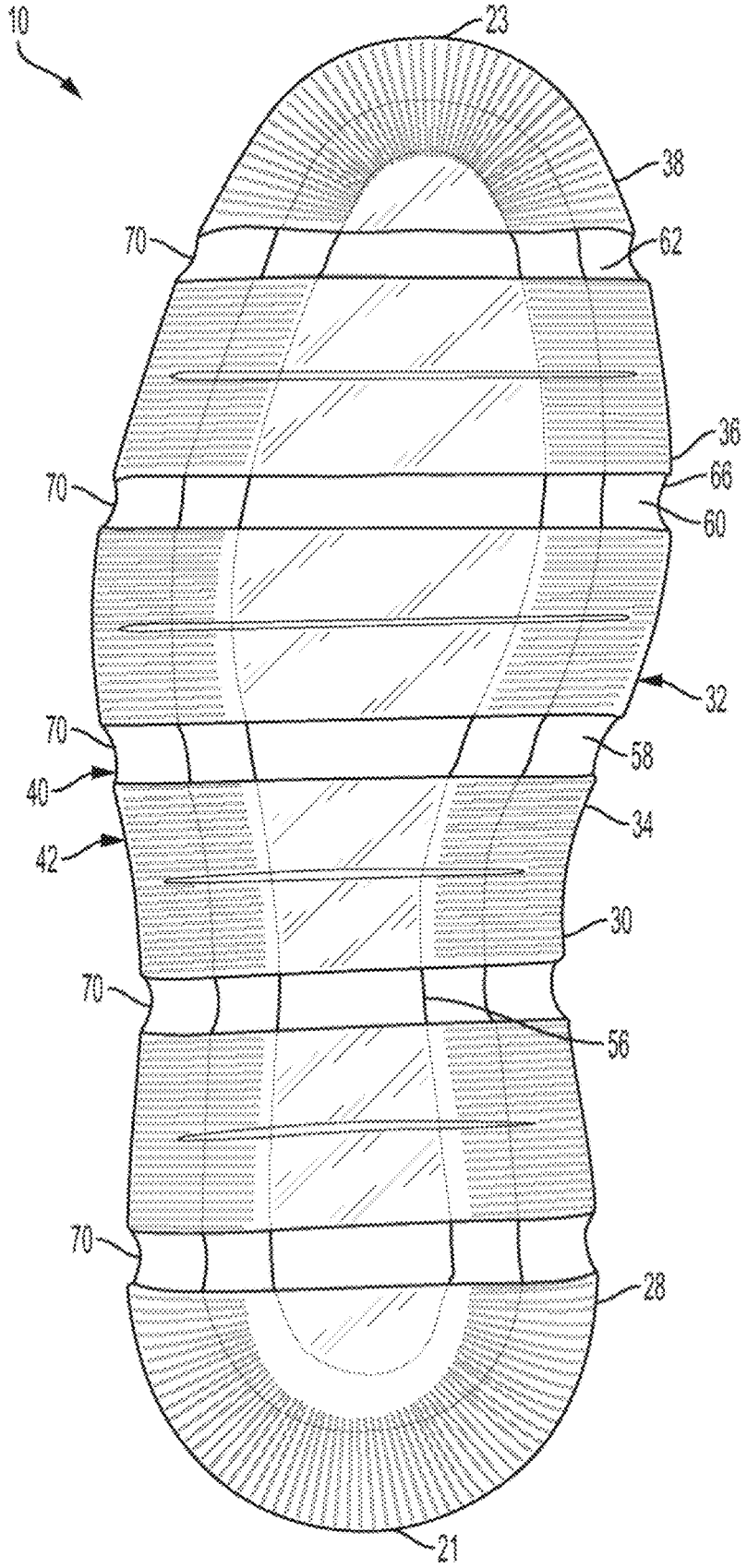
FIG. 8 is a bottom plan view of the shoe of FIG. 1.
Figure 8A:
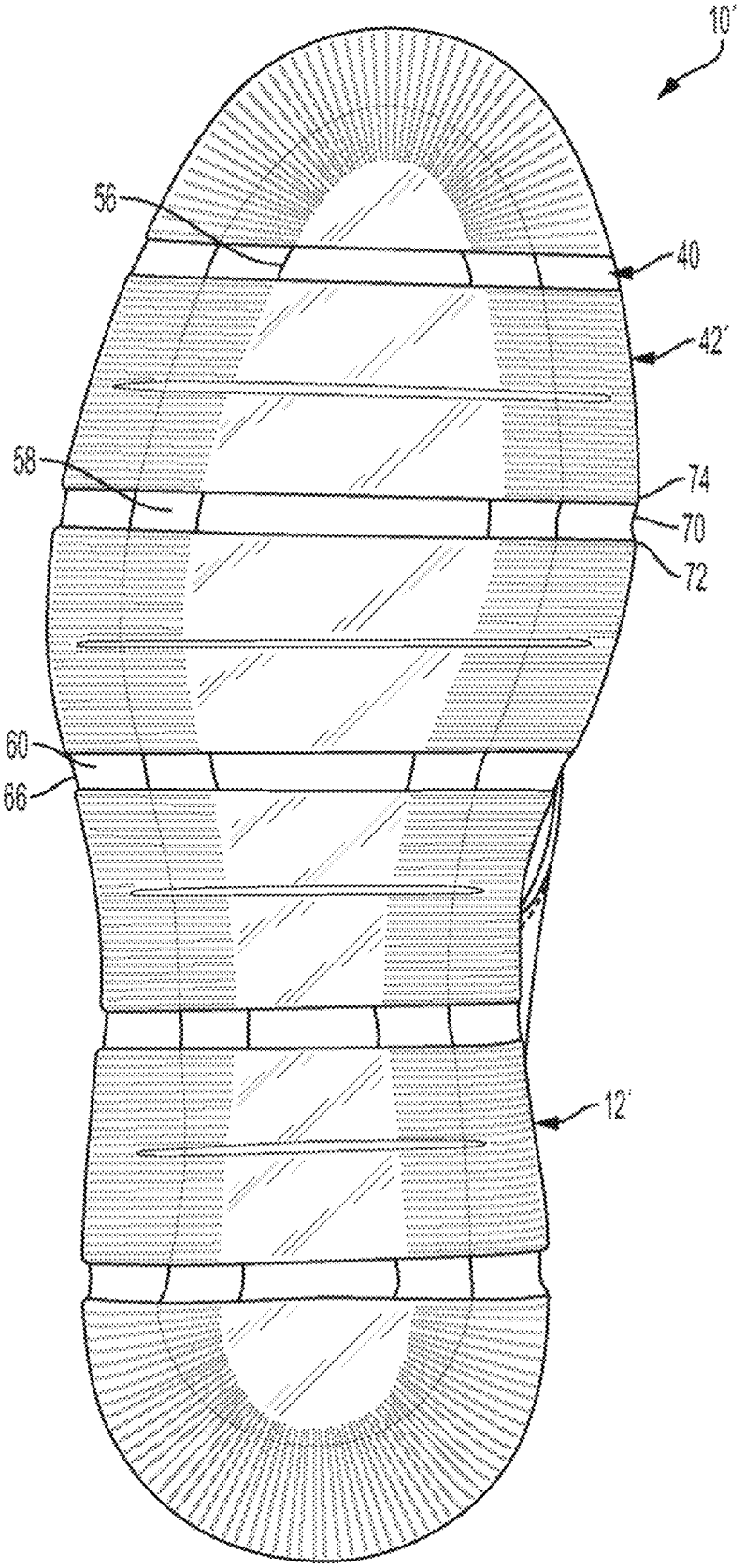
FIG. 8A is a bottom plan view of a shoe according to another embodiment.
Figure 9:
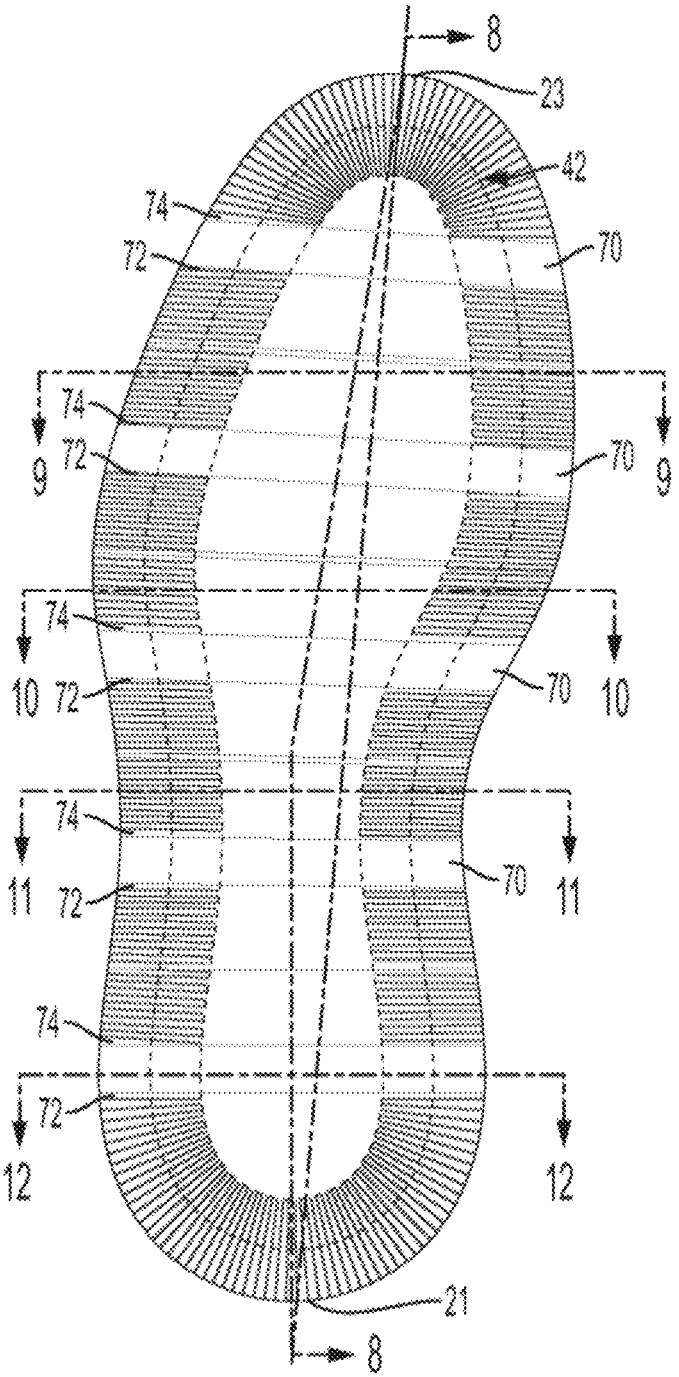
FIG. 9 is a bottom plan view of a sole of the shoe of FIG. 8 or the shoe of FIG. 8A.
Figure 10:
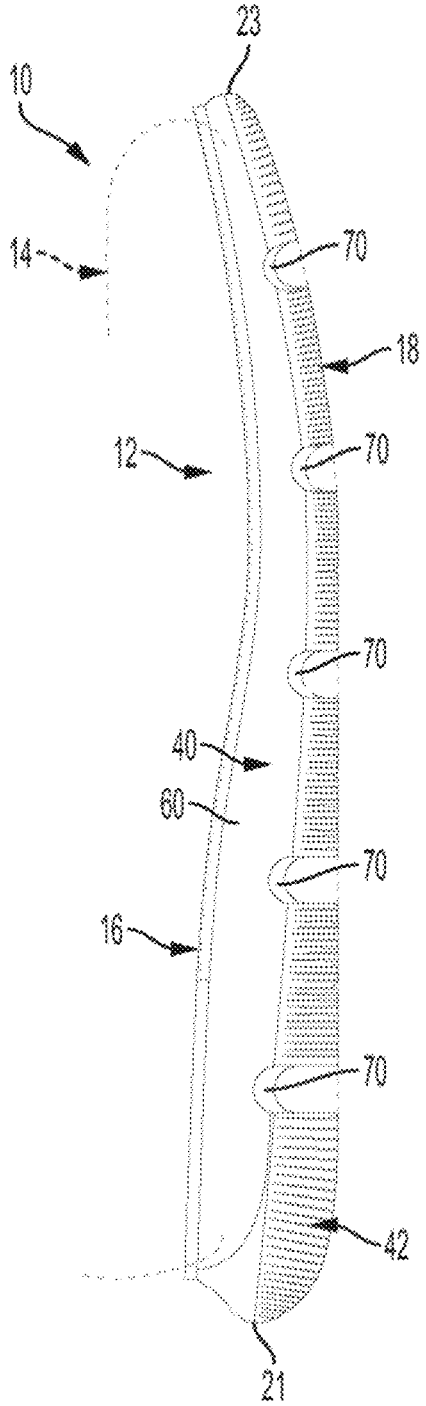
FIG. 10 is a lateral side elevation view of the shoe sole of FIG. 9.
Figure 11:
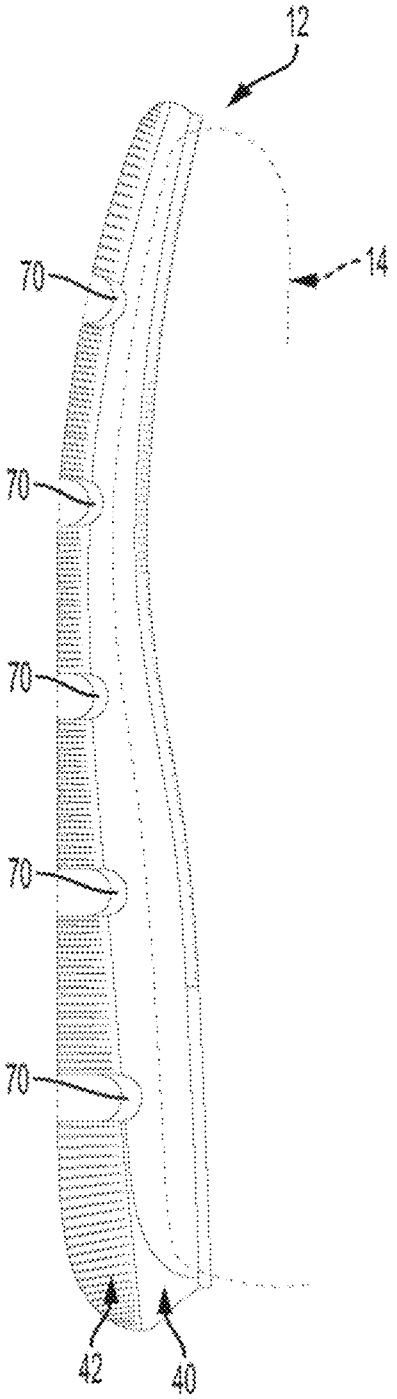
FIG. 11 is a medial side elevation view of the shoe sole of FIG. 9.
Figure 12:
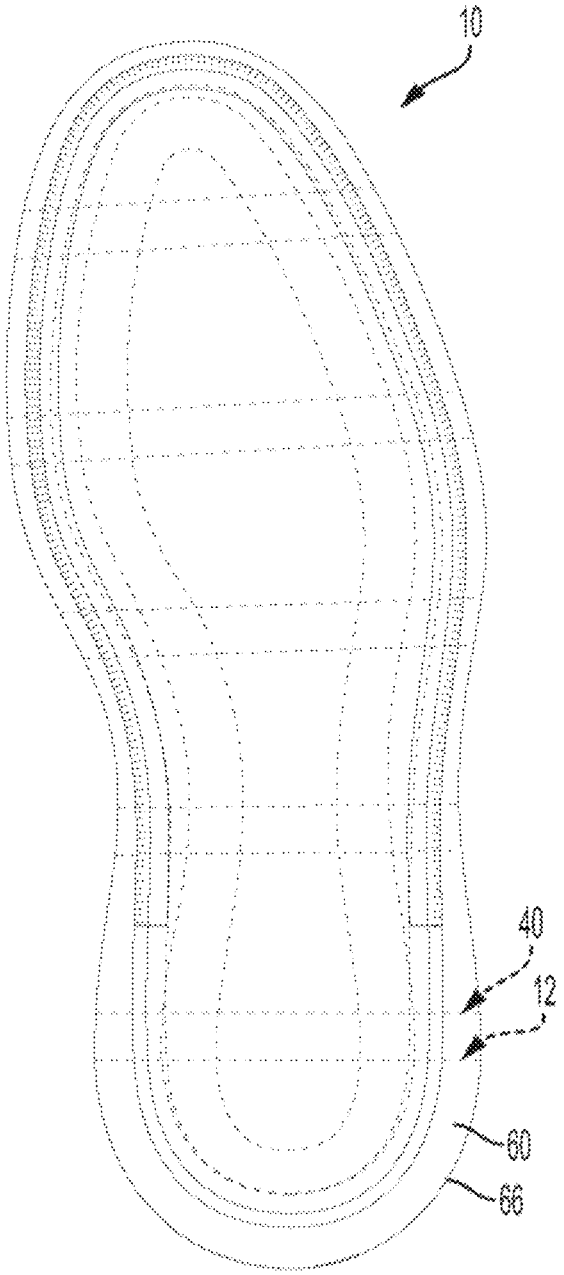
FIG. 12 is a top plan view of the shoe sole of FIG. 9.
Figure 13:
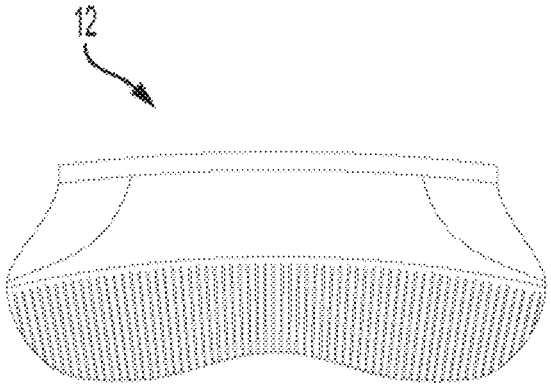
FIG. 13 is a rear elevation view of the shoe sole of FIG. 9.
Figure 14:
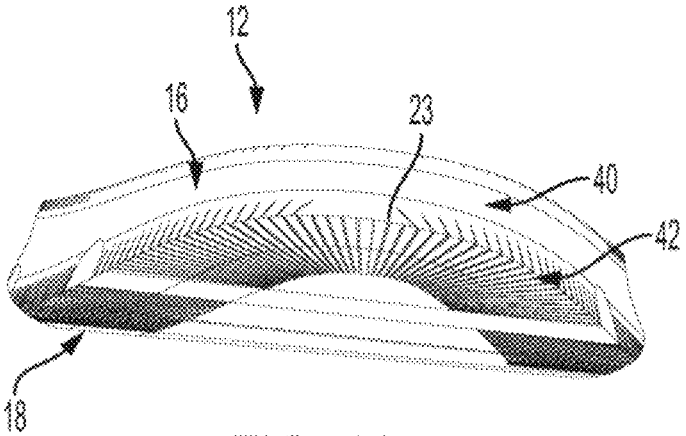
FIG. 14 is a front elevation view of the shoe sole of FIG. 9.
Figure 15:
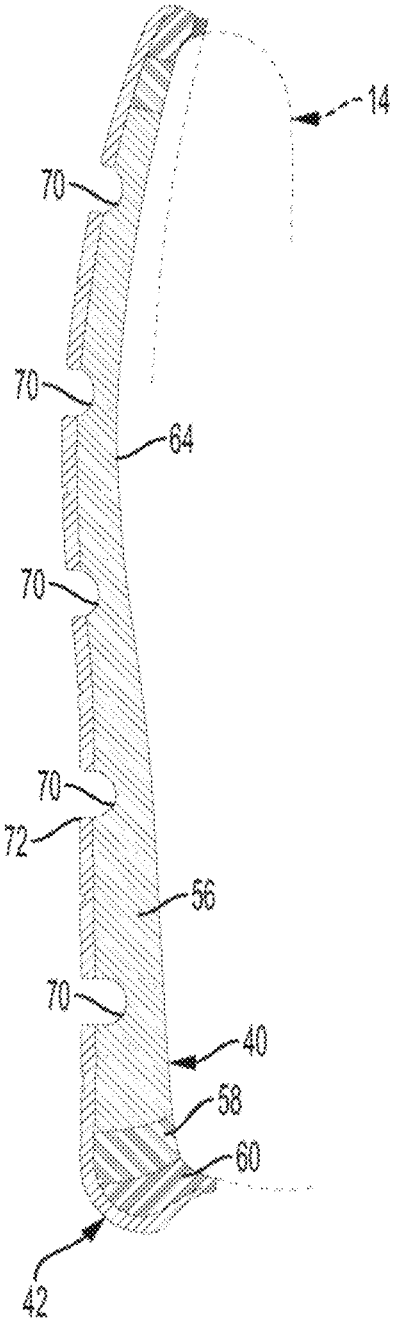
FIG. 15 is a medial cross-sectional elevation view of the shoe sole of FIG. 9.
Figure 16:
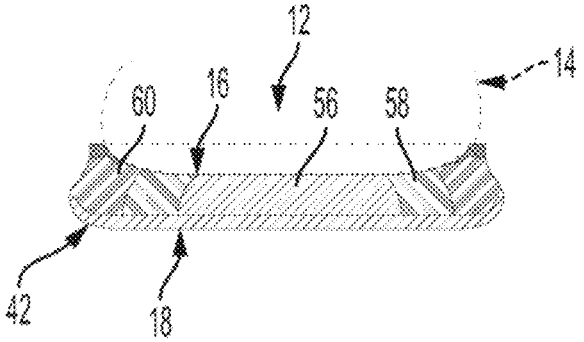
FIG. 16 is a front cross-sectional elevation view of the shoe sole of FIG. 9.
Figure 17:
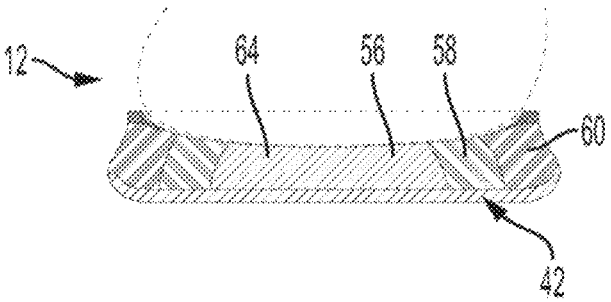
FIG. 17 is a front cross-sectional elevation view of the shoe sole of FIG. 9.
Figure 18:
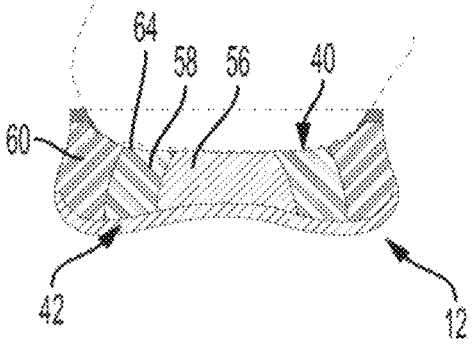
FIG. 18 is a front cross-sectional elevation view of the shoe sole of FIG. 9.
Figure 19:
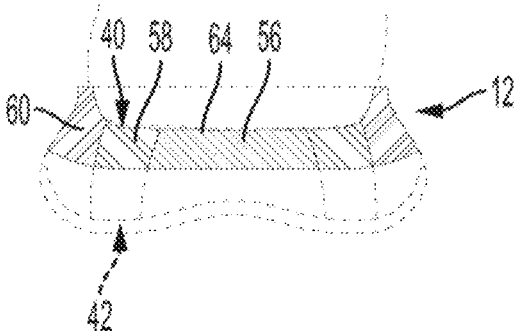
FIG. 19 is a front cross-sectional elevation view of the shoe sole of FIG. 9.

In the embodiment shown in FIG. 8A, a sole 12' of the shoe 10' comprises a colored outsole 42' that is sufficiently translucent such that the midsole portions 56, 58, 60 of the midsole 40 are discernable and distinguishable one from another by a person of normal, unaided vision viewing the outsole 42'.

Figure 20:
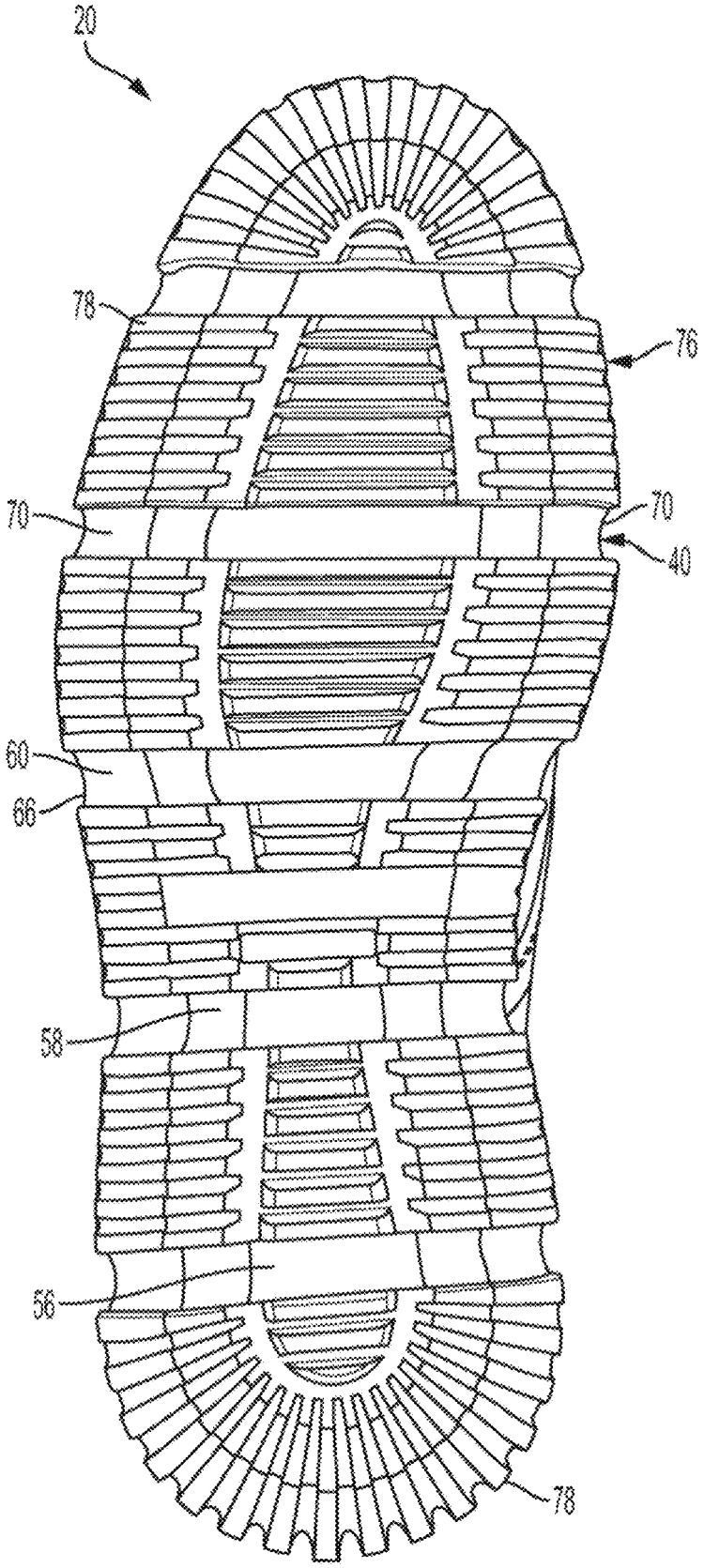
FIG. 20 is a bottom plan view of a shoe in accordance with an aspect of the disclosure.
Figure 20A:
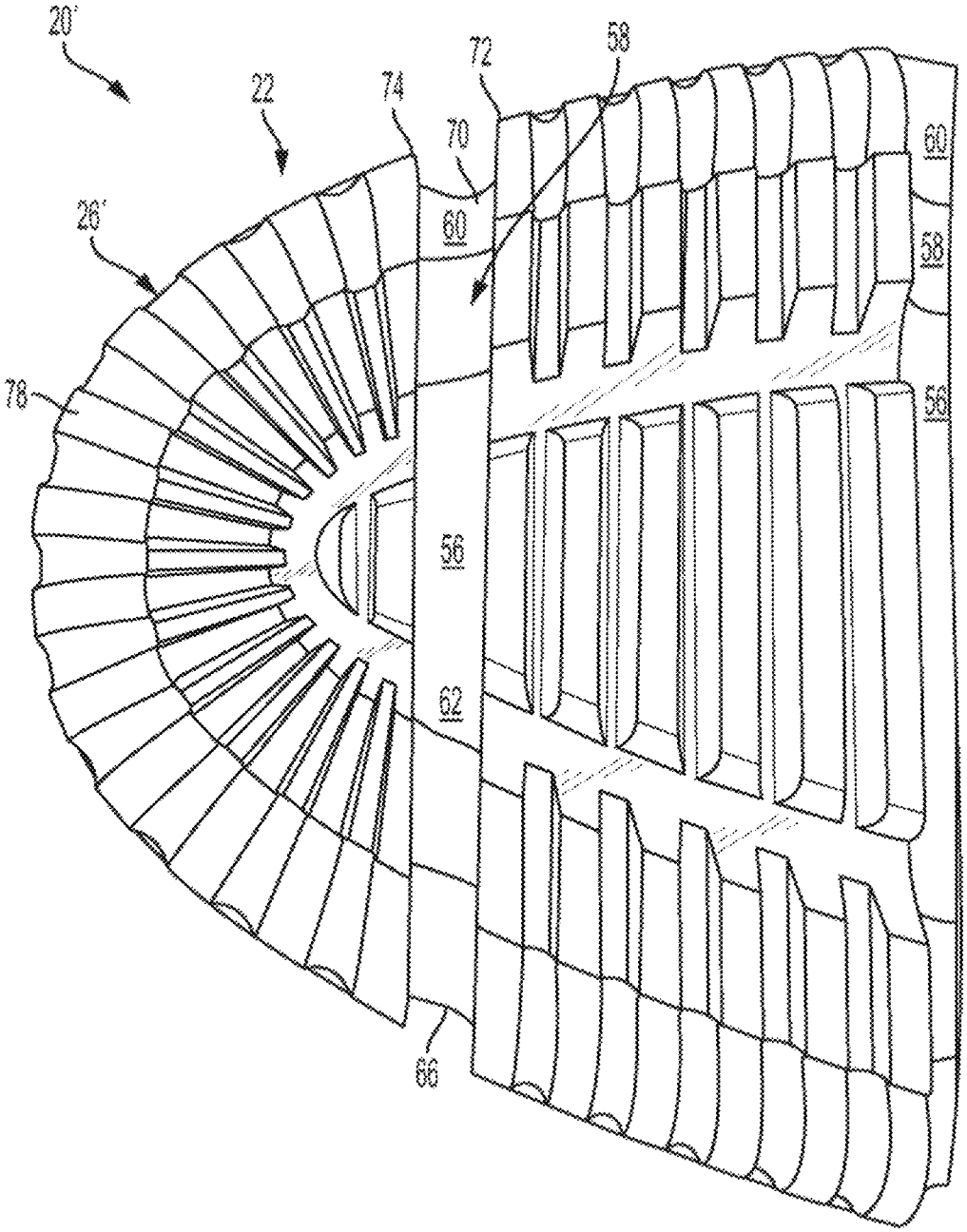
FIG. 20A is a bottom plan view of a portion of a shoe according to another embodiment.
Figure 21:
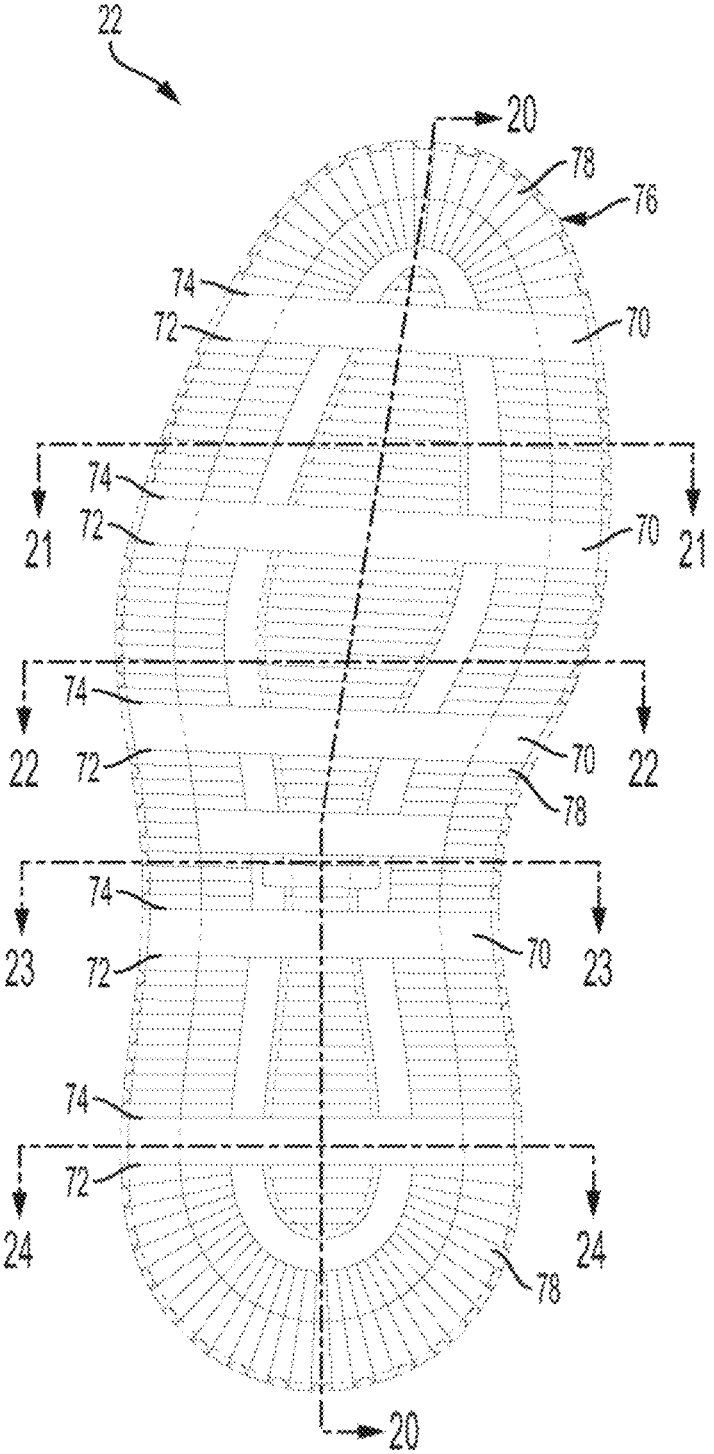
FIG. 21 is a bottom plan view of a sole of the shoe of FIG. 20 or the shoe of FIG. 20A.
Figure 22:
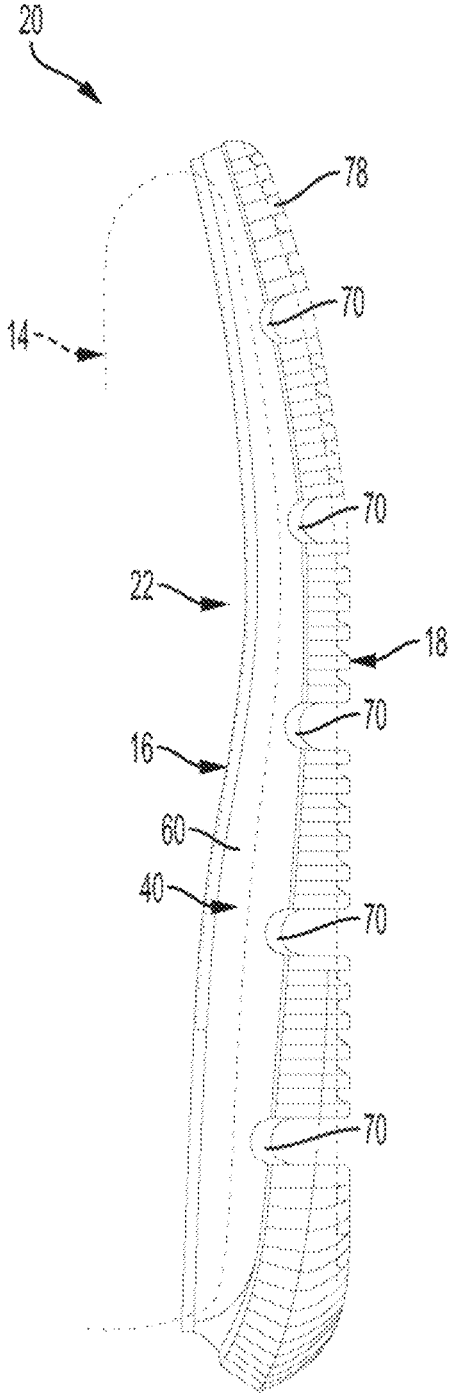
FIG. 22 is a lateral side elevation view of the shoe sole of FIG. 21.
Figure 23:
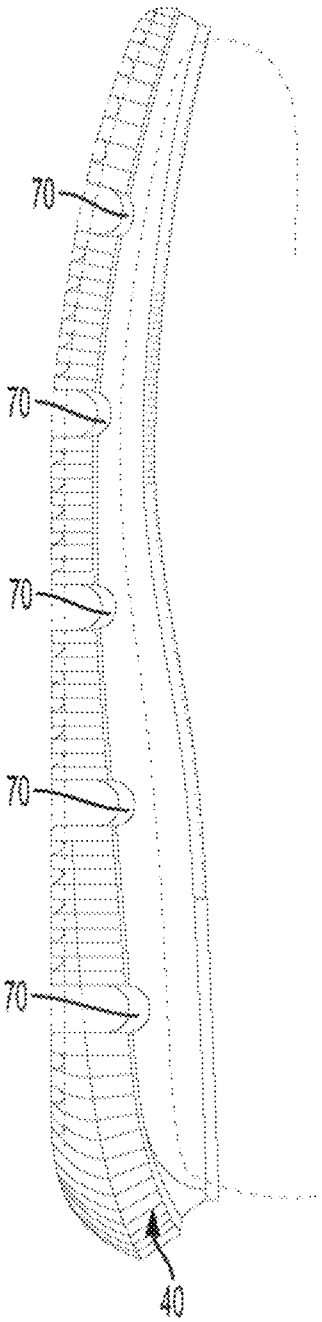
FIG. 23 is a medial side elevation view of the shoe sole of FIG. 21.
Figure 24:
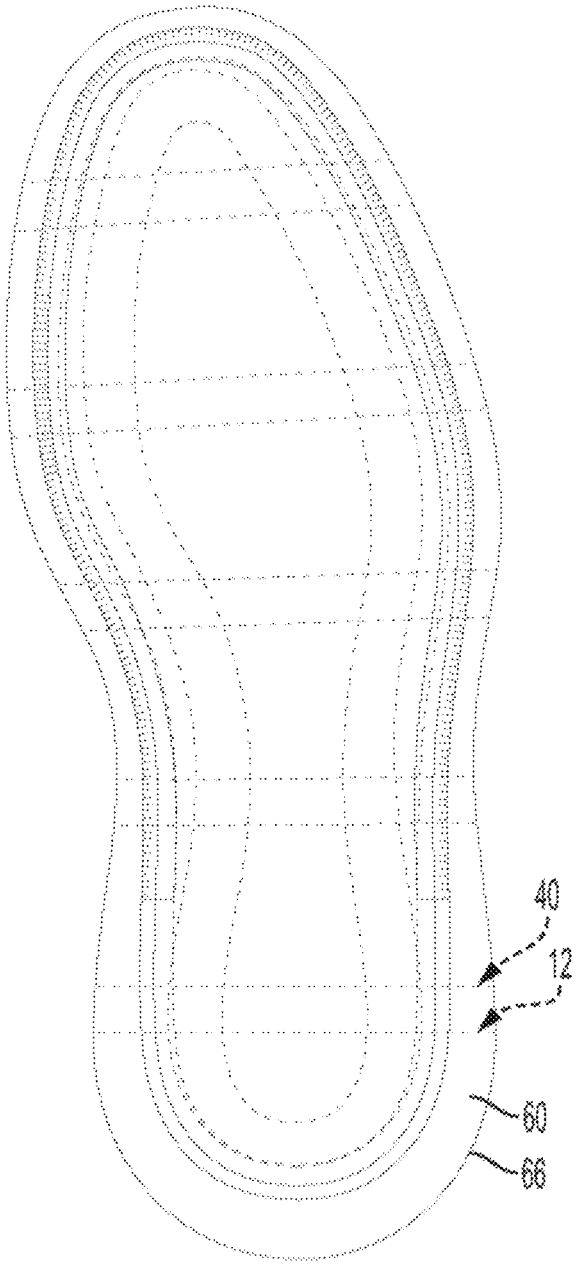
FIG. 24 is a top plan view of the shoe sole of FIG. 21.
Figure 25:
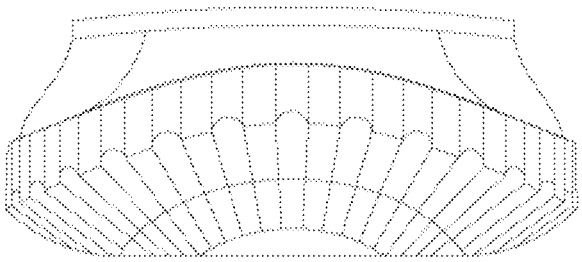
FIG. 25 is a rear elevation view of the shoe sole of FIG. 21.
Figure 26:
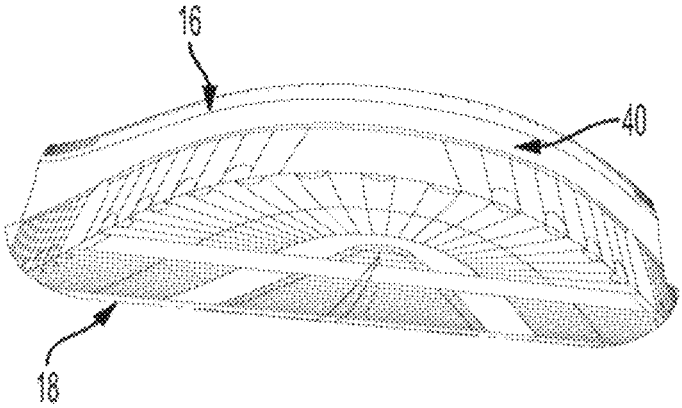
FIG. 26 is a front elevation view of the shoe sole of FIG. 21.
Figure 27:
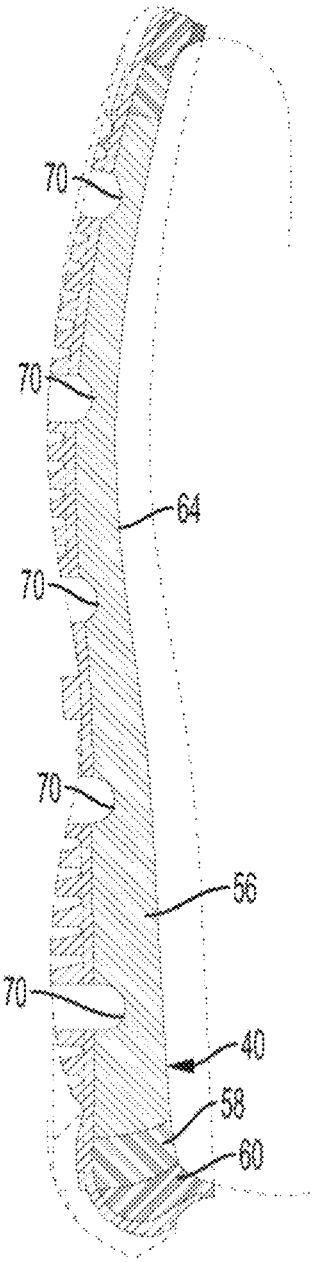
FIG. 27 is a medial cross-sectional elevation view of the shoe sole of FIG. 21.
Figure 28:
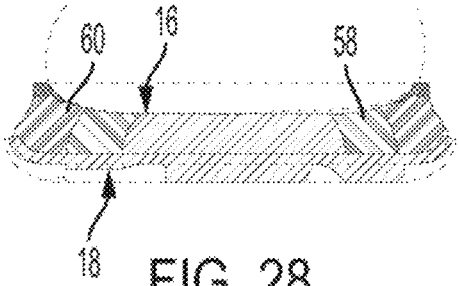
FIG. 28 is a front cross-sectional elevation view of the shoe sole of FIG. 21.
Figure 29:
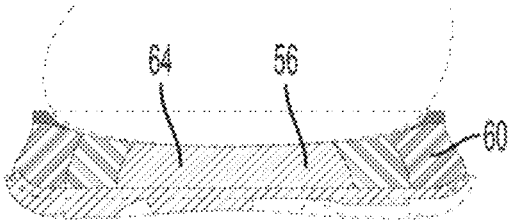
FIG. 29 is a front cross-sectional elevation view of the shoe sole of FIG. 21.
Figure 30:
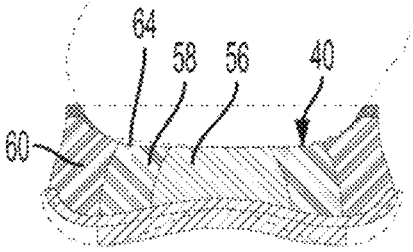
FIG. 30 is a front cross-sectional elevation view of the shoe sole of FIG. 21.
Figure 31:
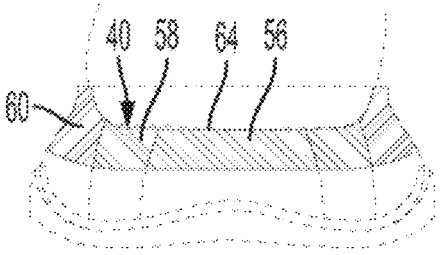
FIG. 31 is a front cross-sectional elevation view of the shoe sole of FIG. 21.

In the embodiment of a shoe depicted in FIG. 20 and illustrated by line drawings in FIGS. 21-31, the sole 22 of shoe 20 comprises a lugged outsole 76 with a plurality of traction ribs 78 formed thereon. Like sole 12, sole 22 is devoid of its outsole 76 in the areas of its flex grooves 70. In the embodiment of a shoe partially depicted in FIG. 20A, the sole 22 of shoe 20' comprises a lugged outsole 76' that is sufficiently translucent such that the midsole portions 56, 58, 60 of the midsole 40 are discernable and distinguishable one from another by a person of normal, unaided vision viewing the outsole 76'.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole; and an upper secured to the sole;

the sole having a sole top side facing the upper and a sole bottom side adapted and configured to engage a ground surface, the sole extending longitudinally from a sole heel end to a sole toe end, the sole extending transversely from a sole lateral edge to a sole medial edge;

the sole having a sole heel region, a sole midfoot region, and a sole forefoot region, the sole heel region extending longitudinally from the sole heel end to the sole midfoot region, the sole midfoot region extending longitudinally from the sole heel region to the sole forefoot region, the sole forefoot region including a sole metatarsal region, a sole ball region, and a sole toe region, the sole metatarsal region extending longitudinally from the sole midfoot region to the sole ball region, the sole ball region extending longitudinally from the sole metatarsal region to the sole toe region, and the sole toe region extending longitudinally from the sole ball region to the sole toe end;

the sole comprising a midsole and an outsole;

the midsole being a one-piece body;

the midsole having a midsole heel region in the sole heel region, a midsole midfoot region in the sole midfoot region, and a midsole forefoot region in the sole forefoot region, the midsole midfoot region extending longitudinally from the midsole heel region to the midsole forefoot region, the midsole forefoot region including a midsole metatarsal region in the sole metatarsal region, a midsole ball region in the sole ball region, and a midsole toe region in the sole toe region, the midsole metatarsal region extending longitudinally from the midsole midfoot region to the midsole ball region, the midsole ball region extending longitudinally from the midsole metatarsal region to the midsole toe region;

the midsole comprising at least a first midsole portion, a second midsole portion circumscribing the first midsole portion, and a third midsole portion circumscribing the second midsole portion and circumscribing the first midsole portion, the first midsole portion having a first midsole durometer hardness, the second midsole portion having a second midsole durometer hardness greater than the first midsole durometer hardness, and the third midsole portion having a third midsole durometer hardness different from the second midsole durometer hardness, the first midsole portion extending from the midsole heel region to the midsole toe region, the second midsole portion extending from the midsole heel region to the midsole toe region, the third midsole portion extending from the midsole heel region to the midsole toe region; and the outsole being secured to a bottom surface of the midsole and having an outsole durometer hardness greater than the second midsole durometer hardness.

2. The shoe in accordance with claim 1, wherein the third midsole durometer hardness is different from the first midsole durometer hardness.

3. A shoe in accordance with claim 1, wherein the third midsole durometer hardness is greater than the second midsole durometer hardness.

4. The shoe in accordance with claim 1, wherein the third midsole durometer hardness is greater than the first midsole durometer hardness and less than the second midsole durometer hardness.

5. The shoe in accordance with claim 1, wherein the first midsole portion extends from the midsole bottom surface to a top surface of the midsole, the second midsole portion extends from the midsole bottom surface to the midsole top surface, and the third midsole portion extends from the midsole bottom surface to the midsole top surface.

6. The shoe in accordance with claim 5, wherein the third midsole portion extends to a perimeter of the midsole.

7. The shoe in accordance with claim 6, wherein the midsole perimeter is entirely comprised in the third midsole portion.

8. The shoe in accordance with claim 5, wherein the second midsole portion contacts at least part of a perimeter of the first midsole portion, and the third midsole portion contacts at least part of a perimeter of the second midsole portion.

9. The shoe in accordance with claim 8, wherein the second midsole portion contacts the entire perimeter of the first midsole portion, and the third midsole portion contacts the entire perimeter of the second midsole portion.

10. The shoe in accordance with claim 1, wherein the midsole bottom surface has a plurality of longitudinally spaced apart flex grooves formed thereon, each flex groove having an area extending transversely from the sole lateral edge to the sole medial edge and longitudinally between a flex groove rear edge and a flex groove front edge; and the sole being devoid of the outsole in each flex groove area.

11. The shoe in accordance with claim 1, wherein the first midsole portion comprises a first EVA foam, the second midsole portion comprises a second EVA foam different from the first EVA foam, and the third midsole portion comprises a third EVA foam different from the second EVA foam.

12. The shoe in accordance with claim 11, the outsole comprising TPU, the TPU being harder than each of the first, second, and third EVA foams.

13. A shoe comprising:

a sole; and an upper secured to the sole;

the sole having a sole top side facing the upper and a sole bottom side adapted and configured to engage a ground surface, the sole extending longitudinally from a sole heel end to a sole toe end, the sole extending transversely from a sole lateral edge to a sole medial edge;

the sole having a sole heel region, a sole midfoot region, and a sole forefoot region, the sole heel region extending longitudinally from the sole heel end to the sole midfoot region, the sole midfoot region extending longitudinally from the sole heel region to the sole forefoot region, the sole forefoot region including a sole metatarsal region, a sole ball region, and a sole toe region, the sole metatarsal region extending longitudinally from the sole midfoot region to the sole ball region, the sole ball region extending longitudinally from the sole metatarsal region to the sole toe region, and the sole toe region extending longitudinally from the sole ball region to the sole toe end;

the sole comprising a midsole and an outsole;

the midsole being a one-piece body;

the midsole having a midsole heel region in the sole heel region, a midsole midfoot region in the sole midfoot region, and a midsole forefoot region in the sole forefoot region, the midsole midfoot region extending longitudinally from the midsole heel region to the midsole forefoot region, the midsole forefoot region including a midsole metatarsal region in the sole metatarsal region, a midsole ball region in the sole ball region, and a midsole toe region in the sole toe region, the midsole metatarsal region extending longitudinally from the midsole midfoot region to the midsole ball region, the midsole ball region extending longitudinally from the midsole metatarsal region to the midsole toe region;

the midsole including at least a first midsole portion of a first color, a second midsole portion being of a second color different from the first color, and a third midsole portion being of a third color different from the second color, the second midsole portion circumscribing the first midsole portion, and the third midsole portion circumscribing the second midsole portion and circumscribing the first midsole portion, the first midsole portion extending from the midsole heel region to the midsole toe region, the second midsole portion extending from the midsole heel region to the midsole toe region, the third midsole portion extending from the midsole heel region to the midsole toe region;

the outsole being secured to the midsole and being sufficiently translucent so that the first, second, and third midsole portions are visually discernable one from another by a person of normal, unaided vision viewing the outsole.

14. The shoe in accordance with claim 13, wherein the outsole is colored.

15. The shoe in accordance with claim 13, wherein:

the first midsole portion has a first midsole durometer hardness, the second midsole portion has a second midsole durometer hardness, and the third midsole portion has a third midsole durometer hardness; and the outsole has an outsole durometer hardness greater than the second midsole durometer hardness.

16. A shoe in accordance with claim 15, wherein the third midsole durometer hardness is the same as the first midsole durometer hardness.

17. A shoe in accordance with claim 15, wherein the third midsole durometer hardness is greater than the second midsole durometer hardness.

18. The shoe in accordance with claim 15, wherein the third midsole durometer hardness is greater than the first midsole durometer hardness and less than the second midsole durometer hardness.

* * * * *